US010738372B2

(12) United States Patent
Wang et al.

(10) Patent No.: US 10,738,372 B2
(45) Date of Patent: Aug. 11, 2020

(54) METHOD OF PROCESSING FULLY AUSTENITIC STAINLESS STEEL WITH HIGH STRENGTH AND HIGH TOUGHNESS

(71) Applicant: Zhejiang University, Hangzhou (CN)

(72) Inventors: Hongtao Wang, Hangzhou (CN); Jiabin Liu, Hangzhou (CN); Youtong Fang, Hangzhou (CN)

(73) Assignee: Zhejiang University, Hangzhou (CN)

( * ) Notice: Subject to any disclaimer, the term of this patent is extended or adjusted under 35 U.S.C. 154(b) by 236 days.

(21) Appl. No.: 15/777,372

(22) PCT Filed: Jun. 5, 2017

(86) PCT No.: PCT/CN2017/087157
§ 371 (c)(1),
(2) Date: May 18, 2018

(87) PCT Pub. No.: WO2017/215479
PCT Pub. Date: Dec. 21, 2017

(65) Prior Publication Data

US 2019/0127830 A1 May 2, 2019

(30) Foreign Application Priority Data

Jun. 17, 2016 (CN) ..... 2016 1 0436538

(51) Int. Cl.
*C21D 6/04* (2006.01)
*C22C 38/58* (2006.01)
(Continued)

(52) U.S. Cl.
CPC ..... *C22C 38/58* (2013.01); *C21D 6/004* (2013.01); *C21D 6/005* (2013.01); *C21D 8/005* (2013.01); *C21D 2211/001* (2013.01)

(58) Field of Classification Search
CPC .. C21D 2211/001; C21D 6/004; C21D 6/005; C21D 8/005; C22C 38/58
(Continued)

(56) References Cited

U.S. PATENT DOCUMENTS 3,917,492 A * 11/1975 Backman ..... C21D 8/005 148/610
4,265,679 A * 5/1981 Ohashi ..... C21D 8/005 148/504

FOREIGN PATENT DOCUMENTS

CN 101045978 A 10/2007
CN 101311291 A 11/2008
(Continued)

OTHER PUBLICATIONS

NPL: On-line translation of CN 101311291 A, Nov. 2008 (Year: 2008).*
(Continued)

*Primary Examiner* — Jie Yang

(57) ABSTRACT

A method of processing fully austenitic stainless steels, comprising the following steps: (1) performing a solution treatment on a raw material with a certain chemical composition, and cooling to get samples, the raw material contains: 0~0.2% of C, 0~0.2% of N, not more than 0.03% of P, not more than 0.001% of S, 0.5%~1% of Si, 1.0%~2.0% of Mn, 15%~17% of Cr, 5%~7% of Ni by weight, the remaining is Fe, and the content of C and N should not be zero simultaneously with a total content of both at 0.15%~0.2%; and (2) performing hot-working for deformation of the samples obtained in step (1), to get a fully austenitic stainless steel. The stainless steel prepared by the hot-working deformation of the present invention has a yield strength of 2 to 3 times of that before hot-working deformation and an elongation of 1.05 to 1.2 times of that before hot-working deformation.

6 Claims, 2 Drawing Sheets

(51) Int. Cl.
*C21D 8/00* (2006.01)
*C21D 6/00* (2006.01)

(58) Field of Classification Search
USPC ..... 148/325
See application file for complete search history.

(56) References Cited

FOREIGN PATENT DOCUMENTS

| | | | |
|---|---|---|---|
| CN | 100569982 | C | 12/2009 |
| CN | 102753717 | A | 10/2012 |
| CN | 105200340 | A | 12/2015 |
| CN | 106167849 | A | 11/2016 |
| CN | 100567550 | C | 12/2019 |
| JP | H06240357 | A | 8/1994 |

OTHER PUBLICATIONS

International Search Report from PCT/CN2017/087157 dated Aug. 16, 2017.
Zhao, Xiancun et al., High /Ultra-High Strength Stainless Steels, Beijing: Metallurgical Industry Press, May 31, 2008 ISBN 978-7-5024-4356-6 and 71-72 (partial translation in English).

* cited by examiner

METHOD OF PROCESSING FULLY AUSTENITIC STAINLESS STEEL WITH HIGH STRENGTH AND HIGH TOUGHNESS

RELATED APPLICATIONS

This application is a 35 U.S.C. § 371 national phase application of PCT/CN2017/087157 (WO2017/215479), filed on Jun. 5, 2017 entitled "Method for Processing High-Strength and High-Toughness Fully-Austenitic Stainless Steel", which application claims the benefit of Chinese Application Serial No. 201610436538.6 , filed Jun. 17, 2016, which is incorporated herein by reference in its entirety.

FIELD OF THE INVENTION

The present invention relates to a method of processing fully austenitic stainless steel with high strength and high toughness with high-strength and high-toughness.

BACKGROUND

After decades of oil production, the oil reservoirs with rich reserves and low difficulty in drilling exploitation have been basically run out. Domestic and international oil drilling has evolved from shallow surface to deep strata, and from the shallow bay to the deep sea. In china, taking Tarim Oilfield as an example, the drilling depth of Ha 7-11H well is 7341.25 meters, the vertical depth is 6645.83 meters, the horizontal displacement is nearly 800 meters, the maximum inclination is 90 degrees and the highest downhole temperature is 168 degrees Celsius, thus creating a new horizontal well drilling record in china. The CNOOC deepwater semi-submersible drilling platform has a maximum operating depth of 3,000 meters, and a maximum drilling depth of 12,000 meters. Internationally the maximum drilling depth is up to 15,000 meters. As the drilling depth increases, the requirements for the performance of oil drilling steel continue to increase. The steel for oil drilling can be divided into magnetic steel and non-magnetic steel according to the magnetic functions. Non-magnetic steel is mainly used as a sensor protection device. Typical application is used in non-magnetic drill collar, to exert bit pressure to the drills, reduce the vibration of the drill bit to make drill bit to operate stably while monitoring the drilling process.

The non-magnetic drill collar must be of fully austenite structure, with excellent hardness, toughness, impact value and corrosion resistance, and low permeability and excellent machinability. At present, the commonly used non-magnetic steel is mainly 200 and 300 series steels. However, for the 200 and 300 series steels, after treatment with conventional methods, their strength and hardness can only reach 50% of the requirements for oil drill collar while ensuring the fully austenite structure. When the 200 and 300 series of steels are subject to conventional cold-working reinforcement, their strength and hardness can be significantly improved, but their ductility and toughness are seriously damaged, and partial or whole austenite is converted to martensite structure, producing strong magnetism. Therefore, the currently used austenitic stainless steel and processing methods are difficult to meet the rigorous requirements for steels with the continuous increase in the drilling depth.

SUMMARY

The object of the present invention is to provide a method of processing fully austenitic stainless steel with high strength and high toughness.

In order to achieve the above object, the invention employs the following technical solutions:

The present invention provides a method of processing fully austenitic stainless steel, comprising the following steps:

(1) Performing a solution treatment on a raw material with a certain chemical composition, cooling to get samples; the raw material contains 0~0.2% of C, 0~0.2% of N, not more than 0.03% of P, not more than 0.001% of S, 0.5%~1% of Si, 1.0%~2.0% of Mn, 15%~17% of Cr, 5%~7% of Ni by weight, the remaining is Fe, and the content of C and N should not be zero simultaneously with a total content of both at 0.15%~0.2%; among all chemical compositions, P and S are impurities;

(2) Performing hot-working for deformation of the samples obtained in step (1), to get a fully austenitic stainless steel; wherein the hot-working deformation is achieved by directly placing cold samples to a processing equipment preheated to the set temperature T1 or directly placing samples preheated to temperature T2 for processing, the deformation amount of hot-working deformation is measured by the cross-sectional shrinkage rate ψ; wherein T1 should be accord with equation (1), T2 should be accord with equation (2), and ψ should be accord with equation (4) or equation (5);

$$M_d+30^\circ\ C. < T1 < 500^\circ\ C. \quad (1)$$

$$M_d+80^\circ\ C. < T2 < 550^\circ\ C. \quad (2)$$

Wherein, in the equation (1) and equation (2), $M_d$ represents the strain maximum temperature of strain-induced martensite, which is calculated according to equation (3):

$$M_d=551-462(C+N)-8.1Mn-9.2Si-13.7Cr-29Ni-1.42(\gamma-8.0) \quad (3)$$

Wherein, in the equation (3), C, N, Si, Cr, Ni, Mn represent the weight percentages of each element, and γ represents the ASTM grain size rating, which can be checked from metallographic structure and standard spectra of control samples;

$$10\% \le \psi \le 10\% + (T1-50)/1000 \quad (4)$$

$$10\% \le \psi \le 10\% + (T2-50)/1000 \quad (5).$$

In the present invention, C is added to the raw material for obtaining high strength and expanding the austenite region, but when the adding amount exceeds 0.2%, Cr carbide will be precipitated on the grain boundary to reduce the steel plasticity, thus its upper limit is set to 0.2%. In order to obtain high strength and expand the austenite region, N is added to the raw material. But when the adding amount exceeds 0.2%, Cr nitride will be precipitated on the grain boundary to reduce the steel plasticity, thus, its upper limit is set to 0.2%. Further, since both C and N can form a compound with Cr, the total upper limit of C and N is set to 0.2%.

In the present invention, the temperature of the solution treatment is preferably within the range of 1050° C.~1150° C. and the holding time is preferably 1 min~2 h in step (1).

In the present invention, the cooling method is water quenching or oil quenching in step (1).

In the present invention, the modes of deformation can be rolling, extruding, forging or drawing in step (2).

In step (2) of the present invention, in order to concentrate the extended dislocations and suppress the planar slip and promote the cross slip of dislocations, the temperature of hot-working deformation is set above $M_D$, which avoids the strain induced martensite and ensure the fully austenite structure. In order to prevent the C and N atoms near the grain boundary from diffusing to the grain boundary to form compounds with Cr that may impair the corrosion resistance of the steel, the temperature of hot-working deformation is set to 550° C. or less.

In the present invention, the degree of hot-working deformation is limited to 10% or more to increase the yield strength of the material by forming high-density dislocations in the crystal grains. However, excessive deformation will lead to dense hexagonal martensite or even cubic martensite inside the grain, to consume some of the phase transformation space in advance and impair the plasticity of the material, so the upper limit is defined as (T1−50)/1000 or (T2−50)/1000.

Preferably, the processing method of the fully austenitic stainless steel comprises step (1) and step (2).

The present invention can achieve the following beneficial effects: the stainless steel prepared by the hot-working deformation of the present invention has a yield strength of 2 to 3 times of that before hot-working deformation and an elongation of 1.05 to 1.2 times of that before hot-working deformation; and it is of a fully austenite structure, with excellent toughness and non-magnetic properties.

DETAILED DESCRIPTION

Figure 1:
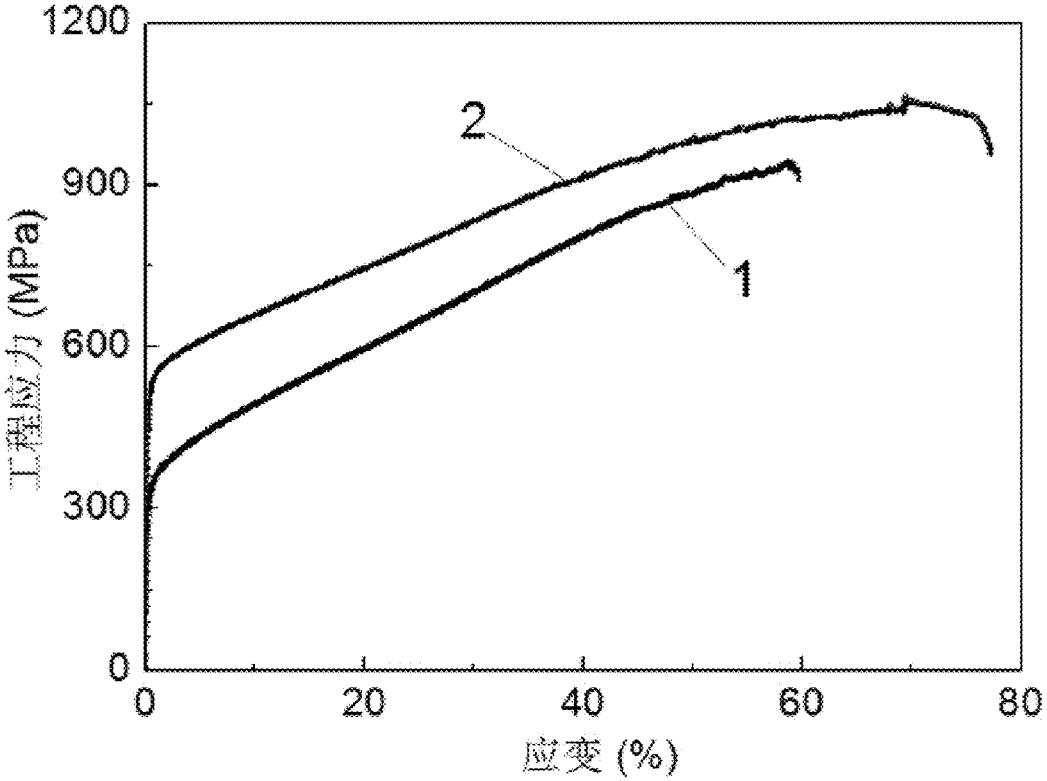
FIG. 1 shows an engineering stress-strain curve in Example 1 of the present invention, 1 represents a sample before hot-working deformation; 2 represents a sample after hot-working deformation.
Figure 2:
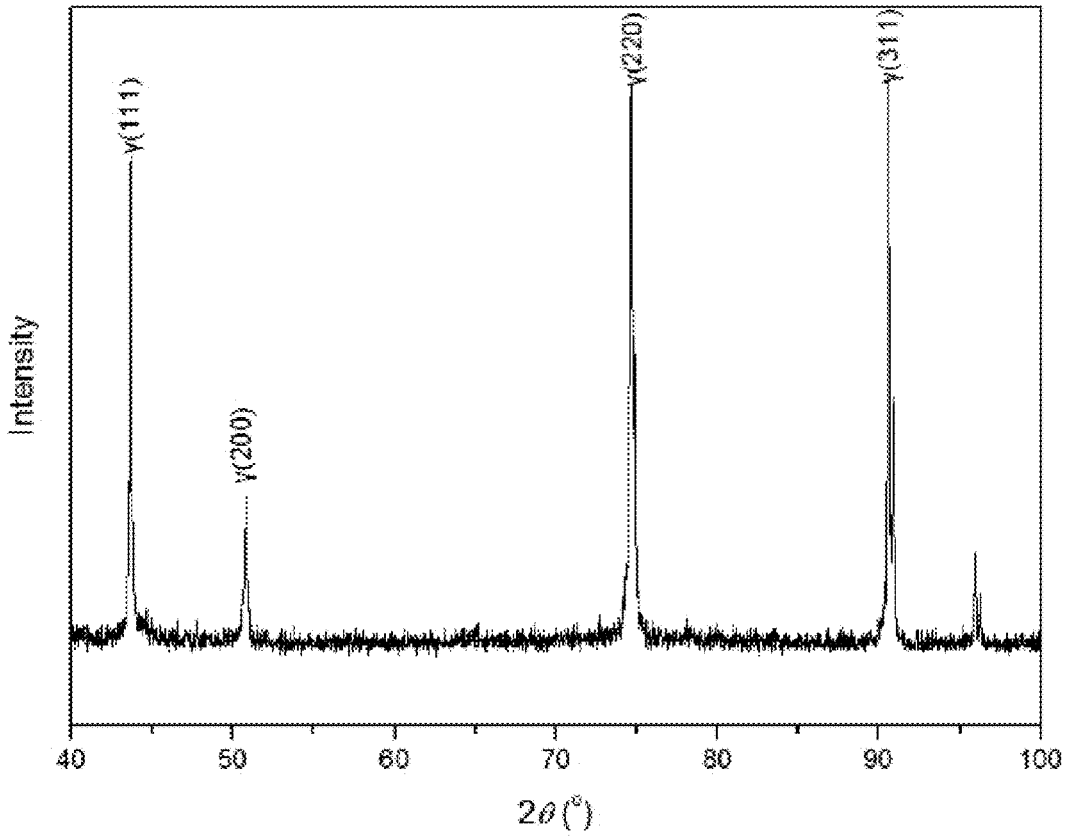
FIG. 2 shows a result of X-ray diffraction of samples after hot-working deformation in Example 2 of the present invention, presenting a fully austenite single-phase structure.
Figure 3:
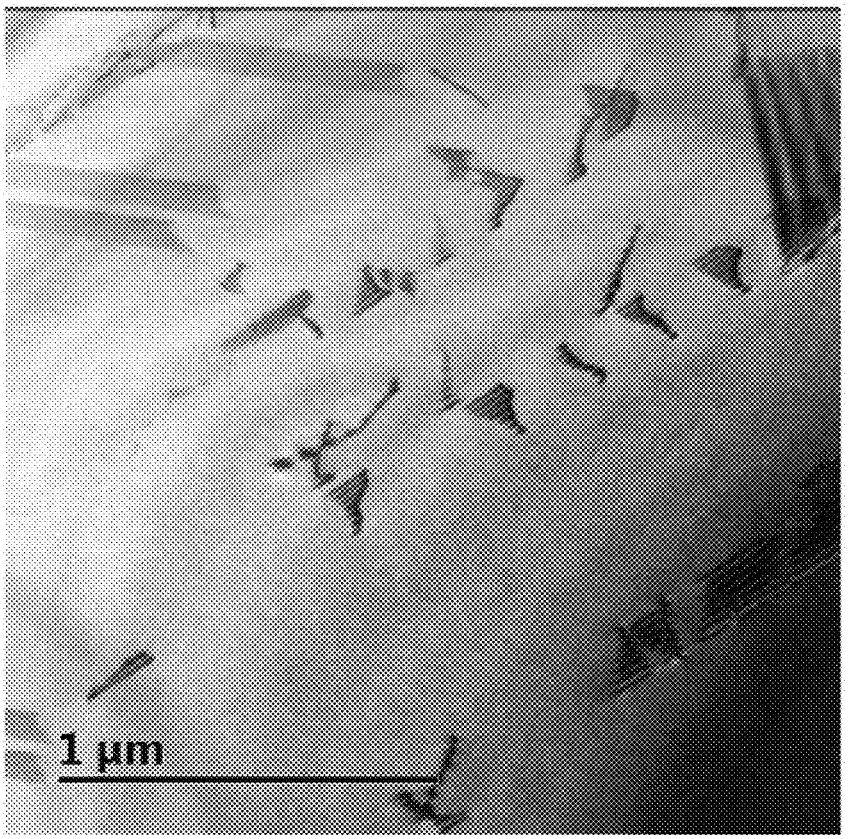
FIG. 3 shows a TEM photograph of samples before hot-working deformation in Example 2 of the present invention, showing that the internal dislocation density of grains is extremely low.
Figure 4:
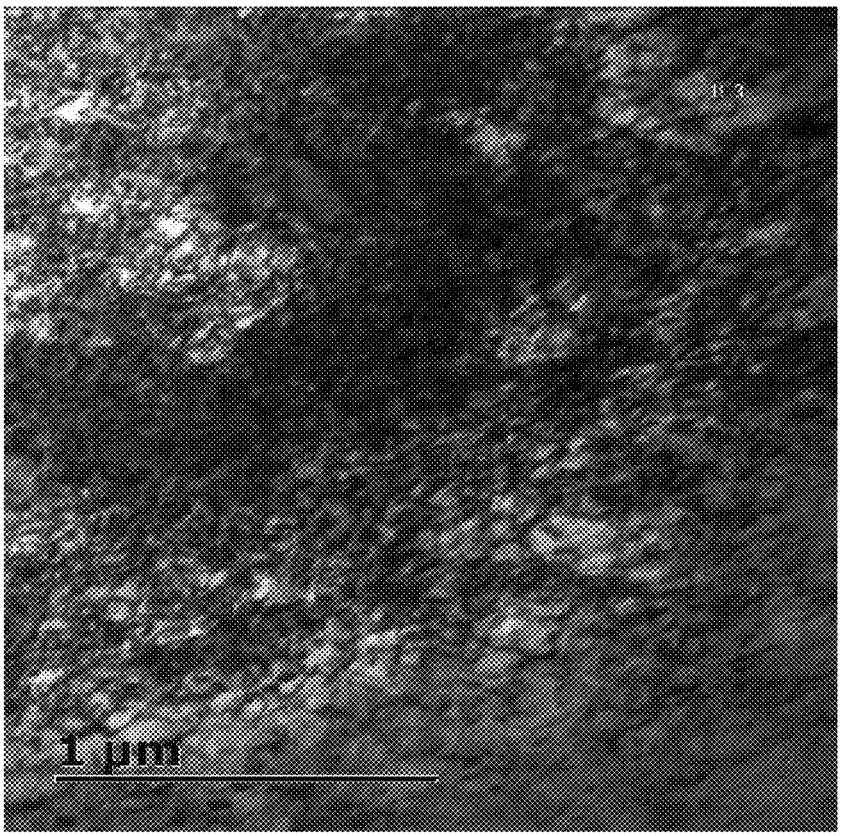
FIG. 4 is a TEM photograph of samples after hot-working deformation in Example 2 of the present invention, showing that the grain contains high-density dislocations and no martensite exists.

The technical solutions of the present invention will be further described with specific embodiments below, but the scope of protection of the present invention is not limited thereto.

Example 1

Stainless steels having compositions of 0.1% C, 0.1% N, 0.03% P, 0.001% S, 0.5% Si, 1.0% Mn, 15% Cr, 5% Ni and remaining Fe are placed to a resistivity and heated to 1050° C. at a rate of 10° C./min, holding 2 h, and a solution treatment is performed by water quenching, to obtain a fully austenite structure. The resulting samples are preheated to 450° C. and then rapidly delivered to a rolling mill for rolling, to achieve a deformation amount with a cross-sectional shrinkage rate at 20%. The obtained samples were subjected to wire-electrode cutting, and then a tensile test is conducted as per GB/T 228.1-2010 *Metallic materials—Tensile testing—Part* 1*: Method of test at room temperature*, to test the yield strength and elongation of samples. The martensite content and austenite content of samples are measured by X-ray diffraction. The resulting samples are rubbed and polished to get a bright mirror surface. Electrolytic corrosion is then performed in a 5% sulfuric acid aqueous solution at a voltage of 20 V at room temperature. The grain size is observed under a metallurgical microscope and the grain size is rated according to the ASTM grain size rating standard.

Example 2

The compositions of materials used: 0.2% C, 0.03% P, 0.001% S, 0.5% Si, 1.0% Mn, 15% Cr, 5% Ni and remaining Fe, other procedures are the same as those in Example 1.

Example 3

The compositions of materials used: 0.2% N, 0.03% P, 0.001% S, 0.5% Si, 1.0% Mn, 15% Cr, 5% Ni and remaining Fe, other procedures are the same as those in Example 1.

Example 4

The compositions of materials used: 0.12% C, 0.05% N, 0.03% P, 0.001% S, 0.5% Si, 1.0% Mn, 15% Cr, 5% Ni and remaining Fe, other procedures are the same as those in Example 1.

Example 5

The compositions of materials used: 0.1% C, 0.07% N, 0.02% P, 0.0007% S, 0.7% Si, 1.5% Mn, 16% Cr, 6% Ni and remaining Fe, other procedures are the same as those in Example 1.

Example 6

The compositions of materials used: 0.05% C, 0.11% N, 0.01% P, 0.001% S, 1% Si, 2% Mn, 17% Cr, 7% Ni and remaining Fe, other procedures are the same as those in Example 1.

Example 7

The compositions of materials used: 0.05% C, 0.05% N, 0.01% P, 0.001% S, 1% Si, 2% Mn, 17% Cr, 7% Ni, and remaining Fe, other procedures are the same as those in Example 1.

Example 8

The step after temperature holding is oil quenching, other procedures are the same as those in Example 1.

Example 9

Samples are heated to 250° C., other procedures are the same as those in Example 1.

Example 10

The samples are preheated and then rapidly delivered to an extruding machine for compressional deformation rather than a rolling mill for rolling. Other procedures are the same as those in Example 1.

Example 11

The samples are preheated and then rapidly delivered to a drawing machine for drawing rather than a rolling mill for rolling. Other procedures are the same as those in Example 1.

Example 12

The samples are preheated and then rapidly delivered to a forging machine for forging deformation rather than a rolling mill for rolling. Other procedures are the same as those in Example 1.

Example 13

The rolling mill especially the rollers are preheated rather than samples. Other procedures are the same as those in Example 1.

Example 14

The extruding machine especially the extruding containers are preheated rather than samples. Other procedures are the same as those in Example 10.

Example 15

The drawing machine especially the molds are preheated rather than samples. Other procedures are the same as those in Example 11.

Example 16

The forging workbench and the forging head are preheated rather than samples. Other procedures are the same as those in Example 12.

Example 17

The cross-sectional shrinkage rate of samples is 10%. Other procedures are the same as those in Example 1.

Example 18

The cross-sectional shrinkage rate of samples is 40%. Other procedures are the same as those in Example 1.

Comparative Example 1

The compositions of materials used: 0.15% C, 0.2% N, 0.01% P, 0.001% S, 1% Si, 2% Mn, 17% Cr, 7% Ni, and remaining Fe, other procedures are the same as those in Example 1.

Comparative Example 2

Samples are heated to 80° C., other procedures are the same as those in Example 1.

Comparative Example 3

Samples are heated to 650° C., other procedures are the same as those in Example 1.

Comparative Example 4

The cross-sectional shrinkage rate of samples is 60%. Other procedures are the same as those in Example 1.

Comparative Example 5

Samples are heated to 150° C. and the cross-sectional shrinkage rate of samples is 40%. Other procedures are the same as those in Example 1.

The basic composition of the present invention is described. Table 1 shows the compositions, mechanical properties and austenite contents in the above examples and comparative examples.

TABLE 1

Compositions, mechanical properties and austenite contents in the examples and comparative examples

| | Before hot-working deformation | | | After hot-working deformation | | |
|---|---|---|---|---|---|---|
| Example 1 | Yield Strength (MPa) | Elon-gation (%) | Grain size γ | Yield Strength (MPa) | Elongation (%) | Austenite percentage |
| Example 1 | 250 | 60 | 10 | 550 | 70 | 100 |
| Example 2 | 245 | 62 | 11 | 550 | 71 | 100 |
| Example 3 | 250 | 60 | 10 | 555 | 70 | 100 |
| Example 4 | 240 | 62 | 11 | 545 | 72 | 100 |
| Example 5 | 240 | 61 | 11 | 540 | 72 | 100 |
| Example 6 | 240 | 62 | 10 | 545 | 71 | 100 |
| Example 7 | 230 | 63 | 10 | 510 | 75 | 100 |
| Example 8 | 250 | 61 | 10 | 550 | 70 | 100 |
| Example 9 | 250 | 60 | 10 | 660 | 65 | 100 |
| Example 10 | 250 | 60 | 10 | 560 | 70 | 100 |
| Example 11 | 250 | 60 | 10 | 570 | 69 | 100 |
| Example 12 | 250 | 60 | 10 | 555 | 70 | 100 |
| Example 13 | 250 | 60 | 10 | 570 | 68 | 100 |
| Example 14 | 250 | 60 | 10 | 560 | 68 | 100 |
| Example 15 | 250 | 60 | 10 | 580 | 66 | 100 |
| Example 16 | 250 | 60 | 10 | 570 | 69 | 100 |
| Example 17 | 250 | 60 | 10 | 550 | 73 | 100 |
| Example 18 | 250 | 60 | 10 | 740 | 64 | 100 |
| Comparative Example 1 | 270 | 61 | 10 | 680 | 55 | 100 |
| Comparative Example 2 | 250 | 60 | 10 | 930 | 32 | 87 |
| Comparative Example 3 | 250 | 60 | 10 | 450 | 54 | 95 |
| Comparative Example 4 | 250 | 60 | 10 | 1250 | 15 | 30 |
| Comparative Example 5 | 250 | 60 | 10 | 1000 | 20 | 40 |

Examples 1 to 7 herein are to investigate the effect of the steel composition on the mechanical properties and the microstructure. Fully austenite structures are obtained in all examples, and the strength and the plasticity obtained after the hot-working deformation are both higher than those before the hot-working deformation. In Example 7, the increase in strength is relatively weaker than that in Examples 1 to 6, indicating that, the higher the C and N contents in the set range, the more obvious the strengthening effect. However, although the steel of Comparative Example 1 also obtains the fully austenite structure, the plasticity after hot-working deformation is lower than that before hot-working deformation, without achieving the effect of increased strength and plasticity, indicating that the C and N contents have reasonable upper limit. Once exceeding the upper limit set in the invention (0.2%), it will form a compound with Cr, to impair the plasticity.

Examples 1 to 8 herein are to investigate the effect of the cooling mode on the mechanical properties and microstructures of steels, and fully austenite structures are obtained in all examples; in addition, both strength and plasticity have been improved, indicating that both oil quenching and water quenching can achieve the object of the invention.

Examples 1 to 9 herein are to investigate the effect of preheat temperature of hot-working deformation on the mechanical properties and microstructures of steels. Fully austenite structures are obtained at 450° C. and 250° C. in all examples; in addition, both strength and plasticity have been improved, indicating that the hot-working deformation within the temperature range set according to equation (3) can achieve the object of the invention. The strength in Example 1 is lower than that in Example 9, indicating that the lower the temperature, the more obvious the strengthening effect within the set temperature range. The plasticity of steels in the Comparative Examples 2 and 3 after hot-working deformation is significantly higher than that before hot-working deformation, without achieving the effect of increase in strength and plasticity. This is because the preheat temperatures in Comparative Examples 2 and 3 are 80° C. and 650° C., which do not meet the requirements of equation (3).

Example 1 and Examples 10 to 12 herein are to investigate the effect of the hot-working deformation mode on the mechanical properties and the microstructure of the steels. Fully austenite structures are obtained no matter through rolling, forging, extruding or drawing. Both the strength and plasticity after hot-working deformation are higher than those before hot-working deformation.

Examples 13 to 16 herein are to investigate the effect of preheating objects on the mechanical properties and microstructures of steels. Fully austenite structures are obtained by preheating the equipments rather than preheating samples. Both the strength and plasticity after hot-working deformation are higher than those before hot-working deformation.

Examples 1, 17, and 18 herein are to investigate the effect of hot-working deformation amount on the mechanical properties and microstructures of steels. Fully austenite structures are obtained within the range set by the equation (5); both the strength and plasticity after hot-working deformation are higher than those before hot-working deformation, and the strength in Example 17 is relatively lower than that in Examples 1 and 18, indicating that the greater the deformation amount within the range set by the equation (5), the more obvious the strengthening effect. In the Comparative Examples 4 and 5, the plasticity of steels after hot-working deformation is significantly higher than that before hot-working deformation, without achieving the effect of increase in strength and plasticity. This is because the deformation amounts in Comparative Examples 4 and 5 do not meet the requirements of equation (5).

What is claimed is:

1. A method of processing fully austenitic stainless steels, comprising the following steps:

(1) Performing a solution treatment on a raw material with a certain chemical composition, cooling to get samples; the raw material contains 0~0.2% of C, 0~0.2% of N, not more than 0.03% of P, not more than 0.001% of S, 0.5%~1% of Si, 1.0%~2.0% of Mn, 15%~17% of Cr, 5%~7% of Ni by weight, the remaining is Fe, and the content of C and N should not be zero simultaneously with a total content of both at 0.15%~0.2%;

(2) Performing hot-working for deformation of the samples obtained in step (1), to get a fully austenitic stainless steel; wherein the hot-working deformation is achieved by directly placing cold samples to a processing equipment preheated to the set temperature T1 or directly placing samples preheated to temperature T2 for processing, the deformation amount of hot-working deformation is measured by the cross-sectional shrinkage rate ψ; wherein T1 should be accord with equation (1), T2 should be accord with equation (2), and ψ should be accord with equation (4) or equation (5);

$$M_d + 30^\circ\text{ C.} < T1 < 500^\circ\text{ C.} \quad (1)$$

$$M_d \lambda 80^\circ\text{ C.} < T2 < 550^\circ\text{ C.} \quad (2)$$

Wherein, in the equation (1) and equation (2), $M_d$ represents the strain maximum temperature of strain-induced martensite, which is calculated according to equation (3):

$$M_d = 551 - 462(C+N) - -8.1Mn - 9.2Si - 13.7Cr - 29Ni - 1.42(\gamma - 8.0) \quad (3)$$

Wherein, in the equation (3), C、N、Si、Cr、Ni、Mn represent the weight percentages of each element, and γ represents the ASTM grain size rating;

$$10\% \le \psi \le 10\% + (T1-50)/1000 \quad (4)$$

$$10\% \le \psi \le 10\% + (T1-50)/1000 \quad (5).$$

2. The method of processing fully austenitic stainless steel according to claim 1, wherein the temperature of the solution treatment is within the range of 1050° C. ~1150° C. and the holding time is 1min~2 h in step (1).

3. The method of processing fully austenitic stainless steel according to claim 2, wherein the cooling method is water quenching or oil quenching in step (1).

4. The method of processing fully austenitic stainless steel according to claim 1, wherein the cooling method is water quenching or oil quenching in step (1).

5. The method of processing fully austenitic stainless steel according to claim 4, wherein the modes of deformation are selected from the group consisting of rolling, extruding, forging and drawing in step (2).

6. The method of processing fully austenitic stainless steel according to claim 5, wherein the processing method of the fully austenitic stainless steel comprises step (1) and step (2).

* * * * *